US011667452B2

(12) United States Patent
Robinson, Jr.

(10) Patent No.: US 11,667,452 B2
(45) Date of Patent: Jun. 6, 2023

(54) EDGE PROTECTOR

(71) Applicant: Jack B. Robinson, Jr., Spartanburg, SC (US)

(72) Inventor: Jack B. Robinson, Jr., Spartanburg, SC (US)

( * ) Notice: Subject to any disclaimer, the term of this patent is extended or adjusted under 35 U.S.C. 154(b) by 0 days.

(21) Appl. No.: 17/411,362

(22) Filed: Aug. 25, 2021

(65) Prior Publication Data

US 2023/0068590 A1 Mar. 2, 2023

(51) Int. Cl.
*B65D 81/05* (2006.01)
*B65D 5/50* (2006.01)

(52) U.S. Cl.
CPC ..... *B65D 81/054* (2013.01); *B65D 5/5033* (2013.01); *B65D 81/056* (2013.01); *B65D 2581/053* (2013.01)

(58) Field of Classification Search
CPC .. B65D 81/054; B65D 5/5033; B65D 81/056; B65D 2581/053
USPC ..... 206/586
See application file for complete search history.

(56) References Cited

U.S. PATENT DOCUMENTS

| | | | | |
|---|---|---|---|---|
| 378,212 | A | 2/1888 | Palmer | |
| 974,871 | A | 11/1910 | Ferres | |
| 1,989,794 | A | 2/1935 | Duvall | |
| 2,160,221 | A | 5/1939 | Masters et al. | |
| 2,670,122 | A | 2/1954 | Davidson et al. | |
| 3,337,111 | A | 8/1967 | Petriekis et al. | |
| 3,613,985 | A | 10/1971 | Goodsite | |
| 3,684,636 | A * | 8/1972 | Rothrock, Jr. et al. | B65D 81/057 428/80 |
| 3,708,101 | A | 1/1973 | McDanield | |
| 3,955,677 | A * | 5/1976 | Collingwood | B65D 81/056 206/453 |
| 3,982,682 | A | 9/1976 | Fremion | |
| 4,027,817 | A | 6/1977 | Fremion | |
| 4,247,289 | A | 1/1981 | McCabe | |
| 4,399,915 | A * | 8/1983 | Sorenson | B65D 5/5033 206/453 |
| 4,440,304 | A * | 4/1984 | Konopko | B65D 81/057 206/586 |
| 4,771,893 | A * | 9/1988 | Liebel | B65D 81/054 206/326 |
| 4,883,179 | A * | 11/1989 | Dionne | B29C 53/066 206/453 |

(Continued)

*Primary Examiner* — Steven A. Reynolds
(74) *Attorney, Agent, or Firm* — Kim and Lahey Law Firm; Hunter Freeman

(57) ABSTRACT

A sheet of foldable material having a plurality of laterally spaced parallel fold lines dividing the sheet into consecutive panels to allow for folding of the panels into overlapping engagement. A notched edge protecting section comprising at least two panels folded into an overlapping engagement and formed from the removal of material from the overlapping panels. An un-notched edge protecting section comprising at least two panels folded into an overlapping engagement and including a first and second leg each having an inner longitudinal edge, outer longitudinal edge and an outside edge wherein the angle between said first longitudinal edge and said outside edge is greater than 90 degrees. A third and a fourth leg formed from the folding of said un-notched edge protecting section so that at least a portion of the inner longitudinal edges of the first and second legs contact one another.

15 Claims, 10 Drawing Sheets

(56) References Cited

U.S. PATENT DOCUMENTS

| | | | | |
|---|---|---|---|---|
| 5,048,689 | A * | 9/1991 | McFarland | B65D 5/5033 206/453 |
| 5,431,985 | A | 7/1995 | Schilling | |
| 5,511,667 | A * | 4/1996 | Carder | B65D 65/44 206/521 |
| 5,813,537 | A * | 9/1998 | DeReu | B65D 81/054 206/453 |
| D407,647 | S * | 4/1999 | Merricks | D9/456 |
| 5,947,290 | A | 9/1999 | Loeschen | |
| 6,561,357 | B2 | 5/2003 | Renck | |
| 6,564,943 | B2 | 5/2003 | Barton et al. | |
| 6,595,367 | B2 | 7/2003 | Baechle | |
| 7,111,734 | B2 | 9/2006 | Robinson, Jr. | |
| 7,228,965 | B2 * | 6/2007 | Marventano | B65D 85/68 206/320 |
| 7,299,924 | B2 * | 11/2007 | Robinson, Jr. | B65D 81/054 206/453 |
| 10,822,138 | B1 * | 11/2020 | Voorhees | B65D 81/053 |
| 10,954,052 | B2 * | 3/2021 | Jette | B31D 5/006 |
| 2002/0189969 | A1 | 12/2002 | Renck | |
| 2005/0092200 | A1 * | 5/2005 | Beauchamp | B41J 11/002 101/409 |

* cited by examiner

EDGE PROTECTOR

BACKGROUND OF THE INVENTION

1) Field of the Invention

The present invention relates to protective packaging materials, and more particularly to an edge protector for placement on the interior or exterior of an article or container, which is uniquely constructed and arranged to maintain its shape for providing reinforcement and protection to the corners of articles and container while also being simple, fast and economical to assemble.

2) Background of the Invention

Edge protectors, corner posts, and the like are generally known in the packaging industry to prevent damage to the edges of articles, as well as add strength to lightweight containers such as cardboard boxes to prevent crushing when stacked.

The prior art is replete with edge or corner protectors, or corner post supports. Examples can be found in U.S. Pat. Nos. 3,613,985; 3,982,682; 4,247,289; 4,399,915; 4,771,893; 5,431,985; 5,813,537; and 6,595,367, each of which have one or more of the following problems. While some provide good cushioning protection, they do not provide a load bearing capacity that strengthens a lightweight container sufficiently to allow for heavy stacking of multiple containers. Others that do provide structural reinforcement tend to be bulky, requiring large amounts of material that waste valuable packaging space and add unwanted weight to the container. In either case, most protectors are typically expensive and time consuming to manufacture. Additionally, and perhaps the worst problem with most corner protectors is that they fail to hold their shape, causing them to be difficult to handle and properly place in a container or around the edge of an article. Sometimes, the edge protector may deform after it is placed in the container, leading to a structural collapse of the container and damage to the item contained therein.

Accordingly, it is an object of the present invention to provide an edge protector that maintains its shape once folded.

It is another object of the present invention to provide an edge protector that is easy and fast to assemble while being economical to produce.

It is another object of the present invention to provide an edge protector that works both as a cushioning member to protect articles, as well as a structural reinforcing member when placed in a container.

SUMMARY OF THE INVENTION

The above objectives are accomplished according to the present invention by first providing a blank sheet of foldable material having a top side and a bottom side. A plurality of fold lines scored into the sheet dividing the sheet into a plurality of consecutive panels to allow for easy folding of the panels into overlapping engagement. A notched edge protecting section is formed by folding at least two panels into an overlapping engagement and removing material from at least two panels folded in an overlapping engagement. An un-notched edge protecting section is formed by folding at least two panels into an overlapping engagement. The sheet of foldable material is folded so that the un-notched edge protecting section extends outwardly from the notched edge protecting section and in at least one embodiment extends outwardly at approximately 90 degrees. In one embodiment, a first leg and a second leg are included in the notched edge protecting section wherein the second leg mirrors the first leg, and each of the first leg and the second leg have an inner longitudinal edge, an outer longitudinal edge and an outside edge interconnecting the inner longitudinal edge and the outer longitudinal edge wherein the angle between the first longitudinal edge and the outside edge is greater than 90 degrees. In one embodiment, a third and a fourth leg are formed from the folding of the un-notched edge protecting section so that at least a portion of the inner longitudinal edge of the first leg contacts at least a portion of the inner longitudinal edge of the second leg.

In at least one embodiment, the first and second legs are perpendicular to the third and fourth legs and the outside edge of the first leg is perpendicular to the outside edge of the second leg. In this embodiment, the angle between the notched edge protecting section and the un-notched edge protecting section is approximately 90°.

In at least one embodiment, the blank sheet of foldable material comprises corrugated paperboard, which is divided into six consecutive panels and one of the notched edge protecting section and the un-notched edge protecting section is formed from the overlapping of panels one, four, and five so that a top side of panel one is placed in face-to-face contact with a top side of panel four, and a top side of panel five is placed in face-to-face contact with a bottom side of panel one while one of the notched edge protecting section and the un-notched edge protecting section is formed from the overlapping of panels two, three, and six so that a top side of panel two is placed in face-to-face contact with a top side of panel three, and a top side of panel six is placed in face-to-face contact with a bottom side of panel two.

In one embodiment, panels three and four are of unequal width so that the notched edge protecting section may be formed with a width that is different than the width of the un-notched edge protecting section, and wherein panel two has a width less than that of panel three. In at least one embodiment, panel one has a width less than that of panel four, panel five has a width greater than that of panel one and less than that of panel four, and panel six has a width less than that of panels two and three.

In at least one embodiment, the edge protector includes a securing member interconnecting the first leg and the second leg so that contact between at least a portion of the first leg and at least a portion of the second leg is maintained.

In one embodiment, the un-notched edge protecting section includes a first side leg and a second side leg, each comprising at least two panels folded into an overlapping engagement wherein the second side leg is integrally connected to the first side leg and is perpendicular to the first side leg. In one embodiment, the notched edge protecting section forms a top section comprising at least two panels folded into an overlapping engagement, wherein the top section is integrally connected to the first side leg and the second side leg and is perpendicular to both the first side leg and the second side leg.

BRIEF DESCRIPTION OF THE DRAWINGS

The construction designed to carry out the invention will hereinafter be described, together with other features thereof. The invention will be more readily understood from a reading of the following specification and by reference to the accompanying drawings forming a part thereof, wherein an example of the invention is shown and wherein.

DETAILED DESCRIPTION OF A PREFERRED EMBODIMENT

Figure 1:
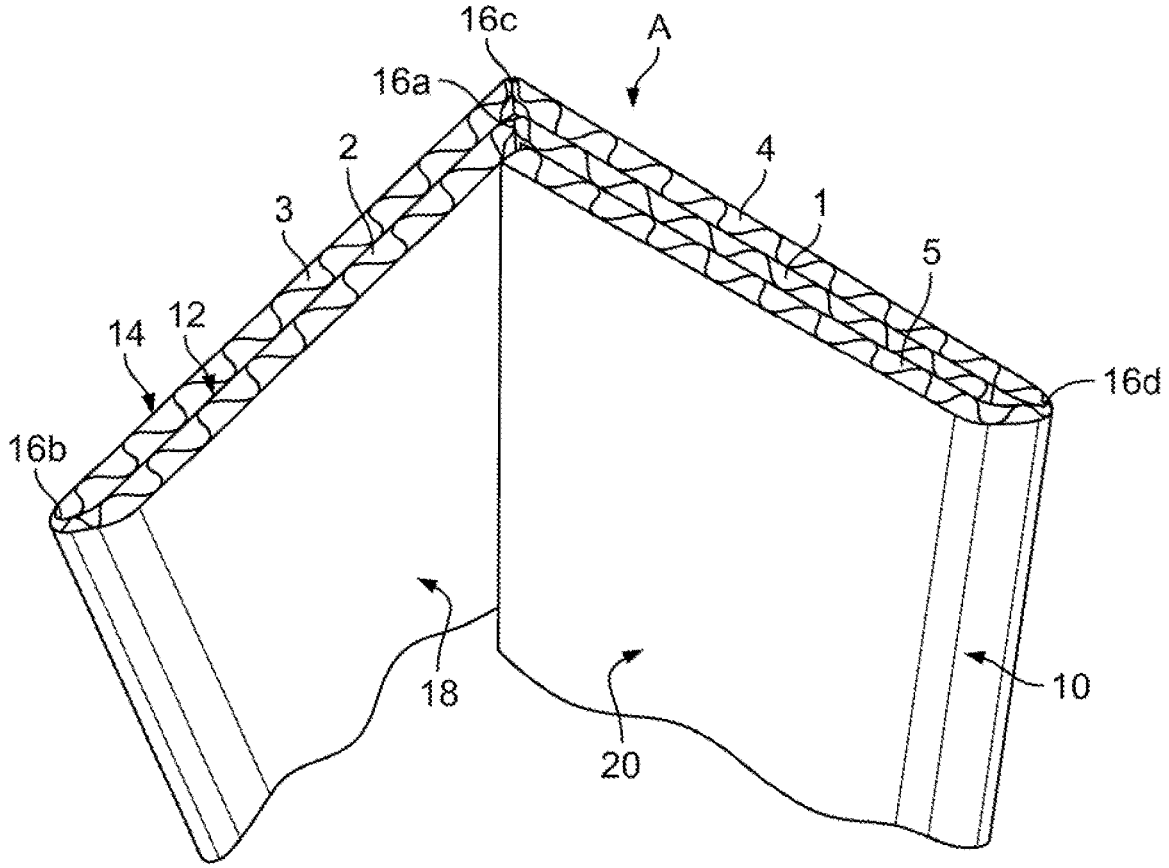
FIG. 1 shows a perspective view of an embodiment of the edge protector according to the present invention.

With reference to the drawings, the invention will now be described in more detail. Referring to FIG. 1, an edge protector, designated generally as A, is shown for protecting the edges and corners of articles during shipping, as well as reinforcing the corners of a shipping container.

Figure 2:
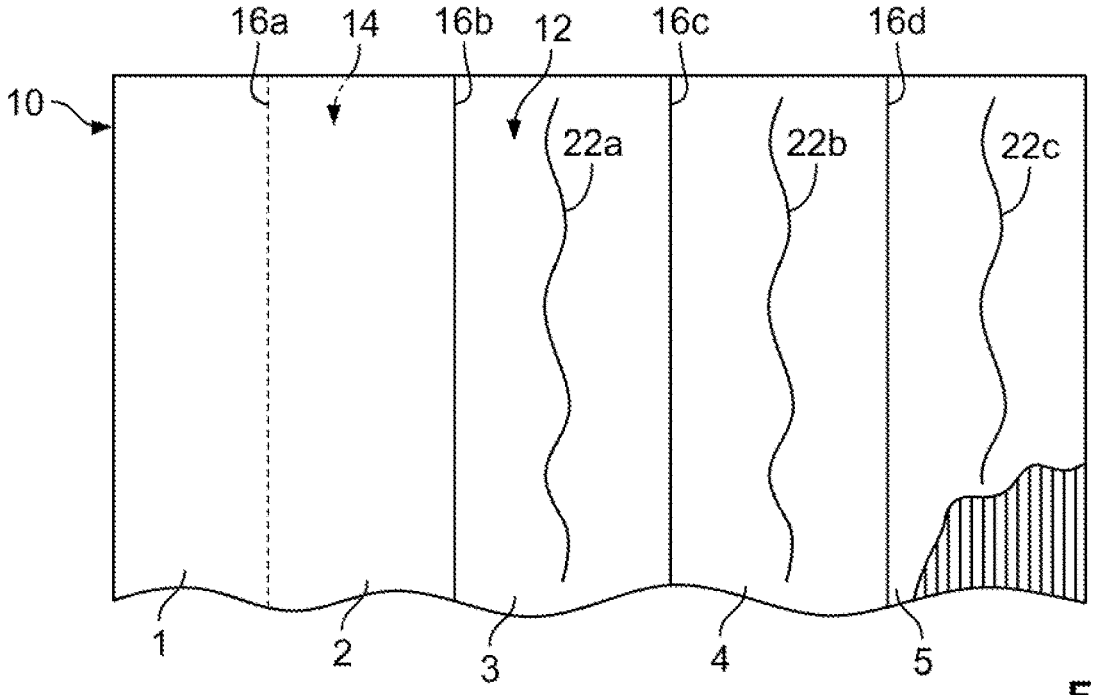
FIG. 2 shows a top view of a corrugated cardboard blank having a series of scored fold lines according to an embodiment of the present invention.

Referring to FIGS. 1-3, a first embodiment of the present invention will be discussed. As shown in FIGS. 1 and 2, this embodiment of the edge protector starts as a blank sheet of foldable material, designated generally as 10, and is folded according to a particular arrangement described herein below into edge protector A, as shown in FIG. 1. Preferably, the blank sheet of foldable material comprises corrugated paperboard, or other like commonly known packaging material, which is inexpensive, durable, and easy to fold. To more easily describe the folding arrangement, sheet 10 is defined as having a top side, designated generally as 12, and an opposite bottom side, designated generally as 14, which is better seen in FIG. 3.

To prepare sheet 10 for folding, a plurality of parallel fold lines 16*a-d* are created into sheet 10 and laterally spaced to divide the sheet into five consecutive panels numbered 1-5. As is true for all embodiments of the present invention described herein, these fold lines can be created by any means, including scoring, denting, depressing and/or perforating the sheet so as to make it more foldable along the fold lines. The panels are accordingly hinged together at the scored fold lines to allow for easy folding of the panels into overlapping engagement. For the embodiment shown in 1-3, it is of particular importance that fold line 16*a* scored between panels 1 and 2 be scored on bottom side 14 of sheet 10, while the rest of fold lines 16*b-d* are scored on top side 12 of sheet 10. As is described in detail below, it is necessary for panel 1 to fold in an opposite manner as the rest of the panels, thereby necessitating fold line 16*a* to be scored on the bottom side of the sheet.

As shown in FIG. 1, a first leg, designated generally as 18, is formed from folding sheet 10 to overlap panels 2 and 3. A second leg, designated generally as 20, intersects first leg 18 and is formed from folding sheet 10 to overlap panels 1, 4, and 5. Advantageously, in a particularly preferred embodiment, an adhesive is place between the overlapping engagement of the panels to help hold them together and maintain the shape of the edge protector. Referring to FIG. 2, glue lines 22*a-c* are placed on top side 12 of panels 3, 4, and 5. Once folded, the adhesive is disposed between the face-to-face contact of panels 2 and 3, panels 1 and 4, and panels 1 and 5 for securing the panels in overlapping engagement and maintaining the first and second legs in a fixed folded arrangement with each other. Preferably, the adhesive is a cold adhesive so as not to immediately tack the panels together during folding to allow the panels to slide into place. As a practical matter, the folding process works best when the glue is placed on the above noted panels after scoring the fold lines and prior to any folding of the panels.

Figure 3A:
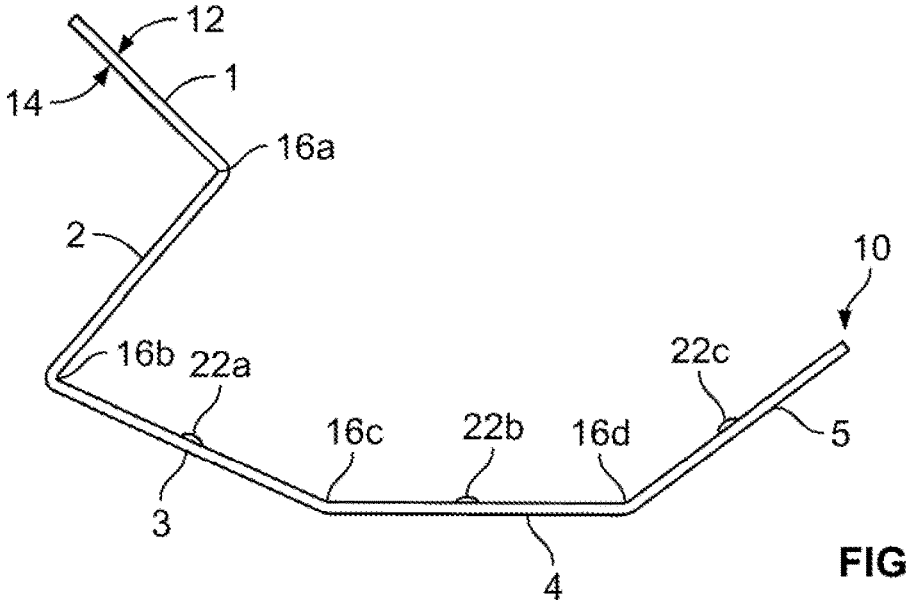
FIG. 3A-3D show side views of the corrugated cardboard blank in various folding stages to illustrate the construction of an embodiment of the edge protector according to the present invention.

Referring to FIGS. 3A-D, the folding arrangement will now be described with particularity. Referring first to FIG. 3*a*, fold lines 16*a-d* have been scored into sheet 10 and laterally spaced to divide the sheet into five consecutive panels hinged together at the fold lines to allow for easy folding of the panels into overlapping engagement. To ensure proper folding of the panels into overlapping engagement so that the panels do not separate and fit together as shown in FIG. 1, it is important that the panels be divided into varying widths for a given thickness. Particularly, it is preferable that panels 3 and 4 be of equal width, as these panels form the length of legs 18 and 20. Panels 1, 2, and 5, however, are preferred to be of unequal width with each having a width less than panels 3 and 4 individually. Particularly, it is preferable that fold lines 16*a-d* be spaced so that panel 1 has a width less than the width of panel 2, and panel 5 has a width greater than the width of panel 1 and panel 2 individually.

By way of example, an embodiment of the invention to be most commonly used provides an edge protector with 2½" legs for wrapping around corners of articles and strengthening the interior corners of shipping containers. To provide the embodiment with 2½" legs that meets the other requirements set forth above as to panel width, requires sheet 10 to be approximately 11¾" in overall width with any desired length. The thickness of the material often ranges anywhere from 1/16" to ¾" or bigger. Preferably, the sheet material is between 1/16" to 3/16" and for this particular embodiment is 2/16". Based on this overall width of 11¾", panel 1 has a width of approximately 2 1/16", panel 2 has a width of approximately 2 5/16", panels 3 and 4 as noted above have a width of approximately 2½", and panel 5 has a width of approximately 2⅜". This allows the panels to fit together without any gaps between engaging surfaces and corners of the panels. It should be noted that the corners must be folded sharply or gaps will form between the panels, leading to a failure of the edge protector to hold its shape. By way of comparison, to provide an embodiment with 3" legs that meets the other panel width requirements set forth above, requires sheet 10 to be approximately 14⅛" in overall width with any desired appropriate length and a thickness of 2/16". Based on this overall width of 14⅛", panel 1 has a width of approximately 2 9/16", panel 2 has a width of approximately 2 13/16", panels 3 and 4 have a width of approximately 3", and panel 5 has a width of approximately 2⅞".

Figure 3B:
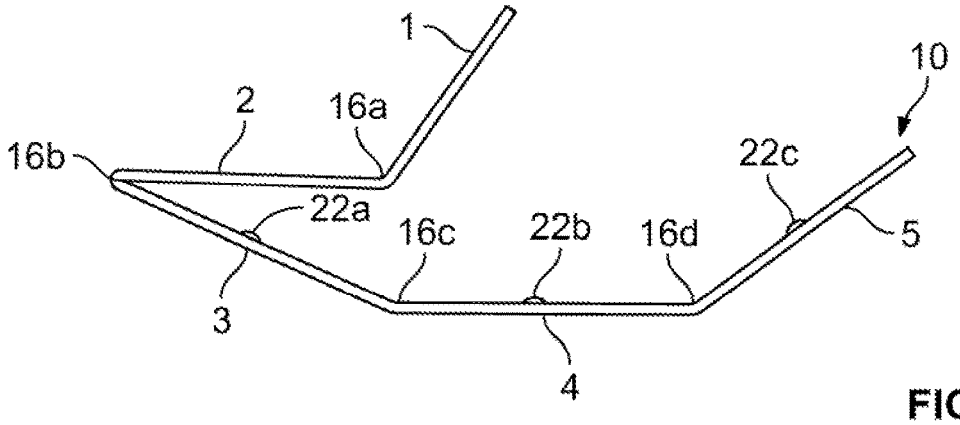
Figure 3C:
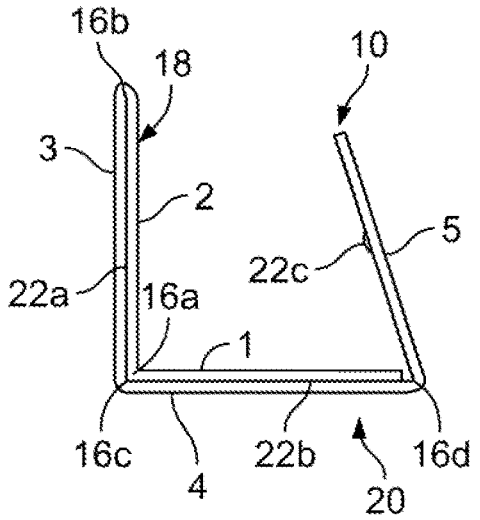

Generally, after sheet 10 has been scored, the sheet is then folded at fold line 16*b* between panels 2 and 3 to overlap panels 3 and 4 with panels 1 and 2 so that top side 12 of panel 2 is placed in face-to-face contact with top side 12 of panel 3, and top side 12 of panel 1 is placed in face-to-face contact with top side 12 of panel 4. As shown in FIG. 3*a*, it is particularly advantageous, however, to first fold sheet 10 at fold line 16*a* between panels 1 and 2 to form approximately a 90° angle between panels 1 and 2 prior to folding panel 2 into overlapping engagement with panel 3, as shown in FIGS. 3*b-c*. Again, note that fold line 16*a* is scored on bottom side 14 of sheet 10 to promote the folding of panel 1 as illustrated in the various Figures. Accordingly, when the sheet is folded at fold line 16*c* between panels 3 and 4 to form approximately a 90° angle between panels 3 and 4, panel 1 then comes into overlapping engagement with panel 4 and is already positioned at a 90° angle to panel 2, which provides good face-to-face contact between the panels.

Figure 3D:
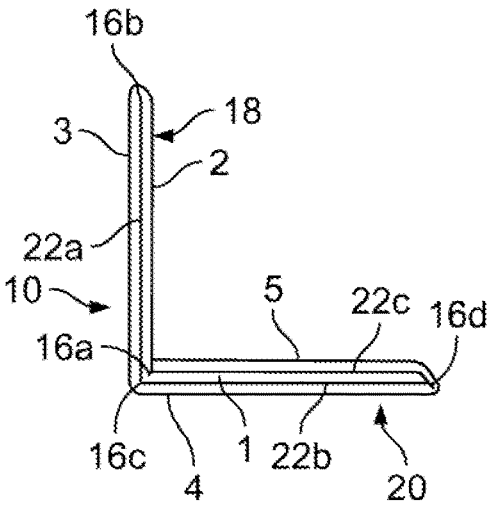

Referring to FIGS. 3*b*-3*d*, first leg 18 is formed from folding sheet 10 at fold line 16*b* to overlap panels 2 and 3 so that top side 12 of panel 2 is placed in face-to-face contact with top side 12 of panel 3. At this point, as shown in FIG. 3*c*, panels 1 and 4 are also positioned in overlapping engagement so that top side 12 of panel 1 is placed in face-to-face contact with top side 12 of panel 4, which generally intersect panels 2 and 3 at a 90° angle.

Next, sheet 10 is folded at fold line 16*d* between panels 4 and 5 so that top side 12 of panel 5 is placed in face-to-face contact with bottom side 14 of panel 1, which locks the panels together in position through a combination of the folding arrangement and the adhesive discussed above provided in the form of glue lines 22*a-c*. This forms second leg 20 intersecting with first leg 18. Accordingly, second leg 20 is thus formed from folding sheet 10 to overlap panels 1, 4, and 5 so that the top side of panel 1 is placed in face-to-face contact with the top side of panel 4, and the top side of panel 5 is placed in face-to-face contact with the bottom side of panel 1.

Figure 4:
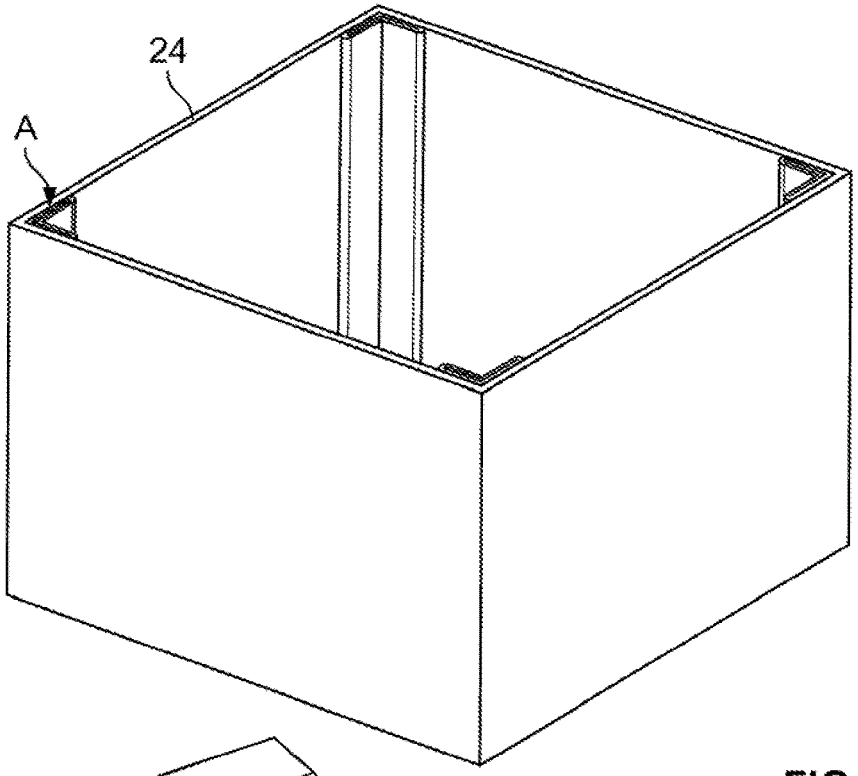
FIG. 4 shows a perspective view of one application of the edge protector according to the present invention.
Figure 5:
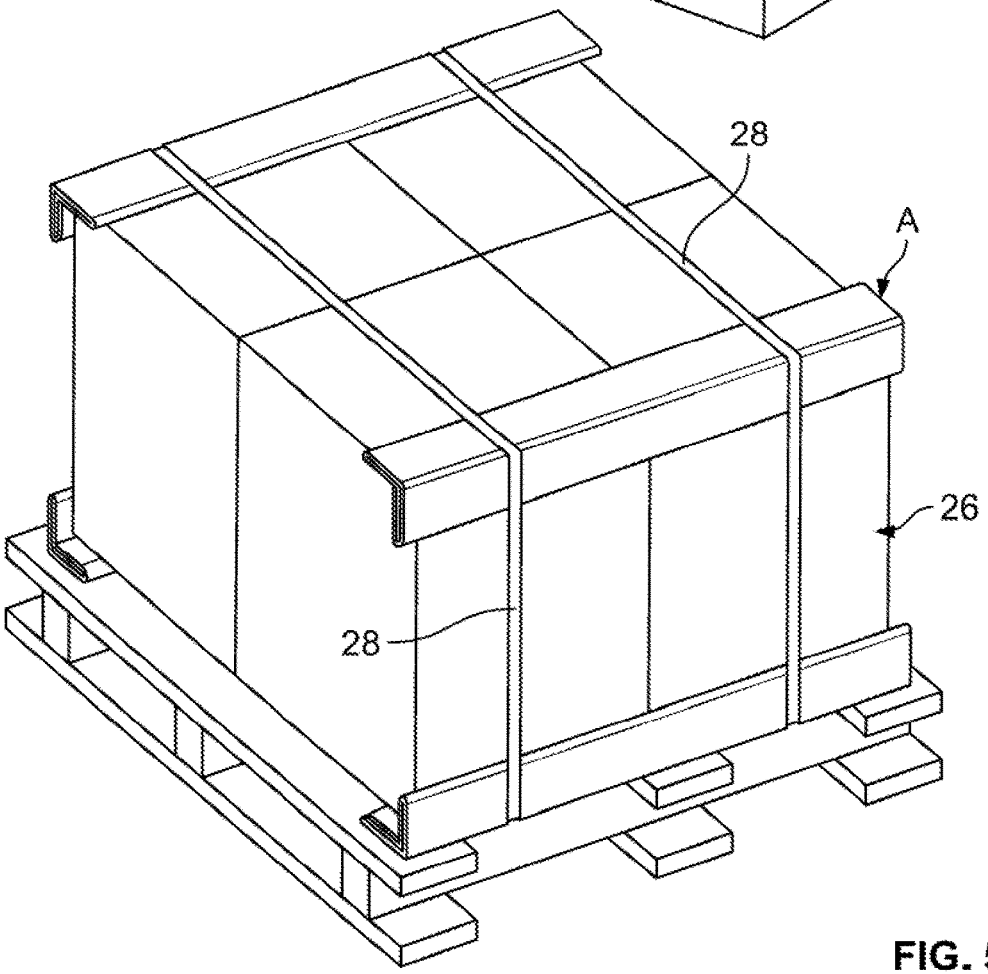
FIG. 5 shows a perspective view of another application of the edge protector according to the present invention.

Preferably, the first leg and the second leg intersect at approximately a 90° angle with each other to provide an edge protector for right angles, as well as to reinforce the edges of paperboard boxes and the like. Accordingly, referring to FIGS. 4 and 5, perspective views are provided showing some of the uses for the edge protector according to the present invention. As shown in FIG. 4, a cardboard box 24 includes edge protectors A positioned in all four corners of the box, adding structural stacking strength and resilience to the most important portions of the box without taking up large amounts of interior packaging space. Alternatively as shown in FIG. 5, a plurality of edge protectors A are used to protect the corners of a pallet of cartons, designated generally as 26, as well as holding the cartons in place by way of straps 28. In this manner straps 28 can be tightened to secure the load by biting into the edge protectors without any damage occurring to the cartons.

Figure 6:
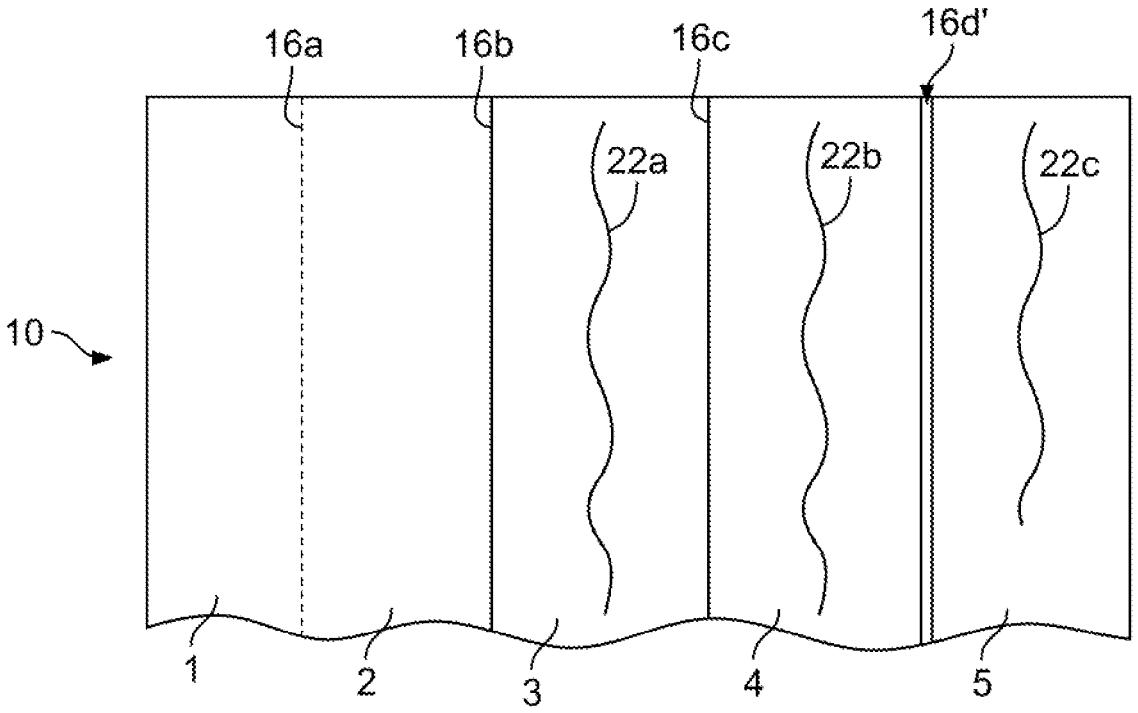
FIG. 6 shows a top view of a corrugated cardboard blank having a series of scored fold lines and glue lines according to an alternative embodiment of the present invention.
Figure 7:
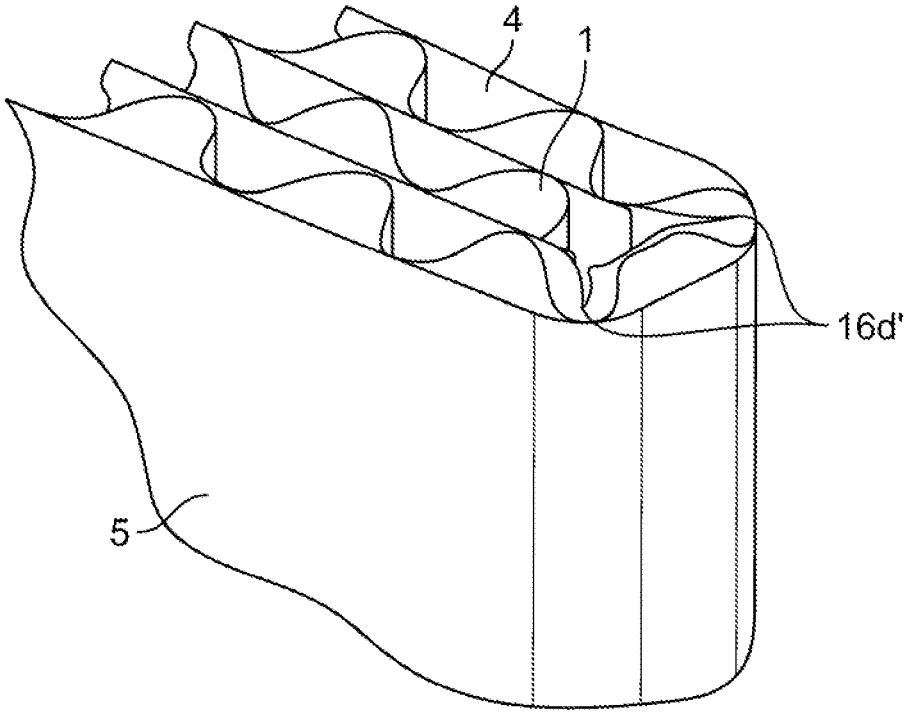
FIG. 7 shows a perspective view of an alternative embodiment of the edge protector according to the present invention.

Referring to FIGS. 6 and 7, in an alternative embodiment, a double score fold line, designated generally as 16*d*', connects panel 4 and panel 5. Essentially, the double score fold line includes a pair of fold lines laterally spaced the thickness of the sheet 10 for allowing panel 5 to be double hinged to panel 4 so that when panel 5 is folded into overlapping engagement with panel 1, the double score allows panel 5 to easily fold around the thickness of panel 1. This helps the panels hold their shape by reducing the force of panel 1 pushing against panel 5 at the fold line. Further, a double score fold line can be proved between panels 2 and 3 when using thick paperboard to accommodate for the thickness.

Figure 8:
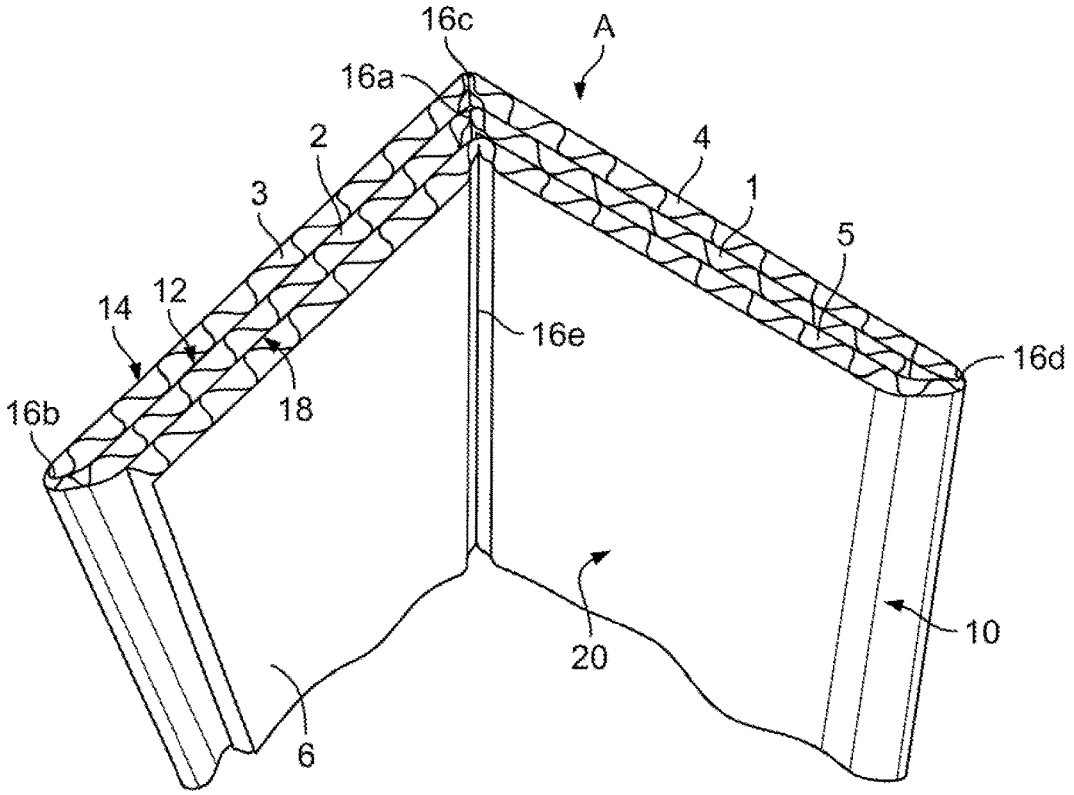
FIG. 8 shows a perspective view of a further advantageous embodiment of the edge protector according to the present invention.
Figure 9:
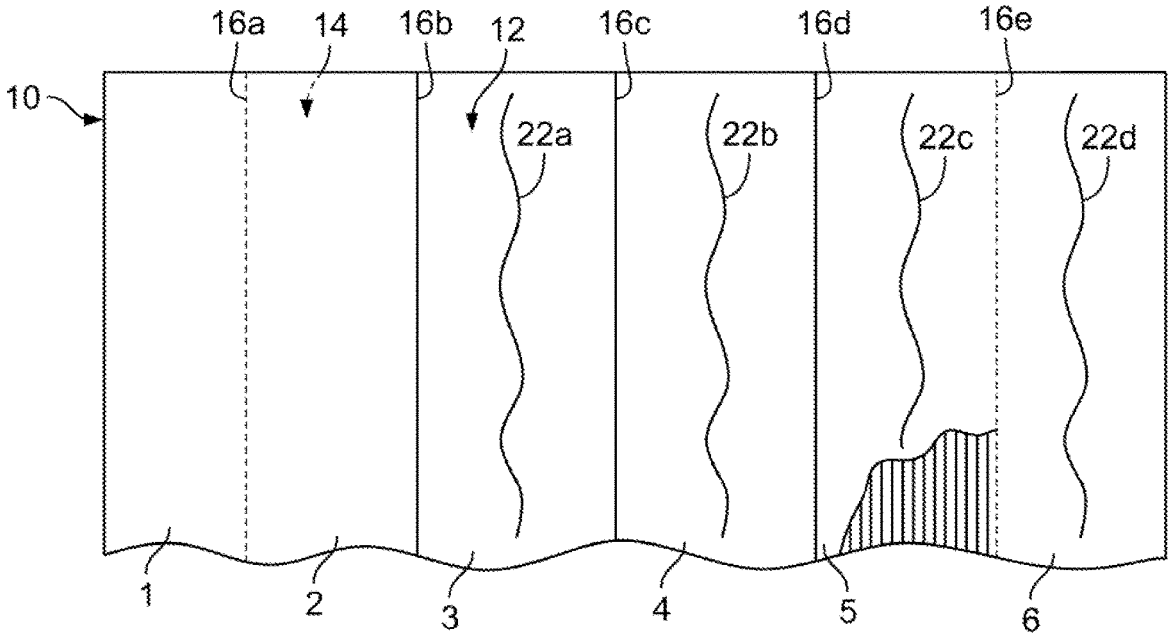
FIG. 9 shows a top view of a corrugated cardboard blank having an additional scored fold line according to the present invention.
Figure 10A:
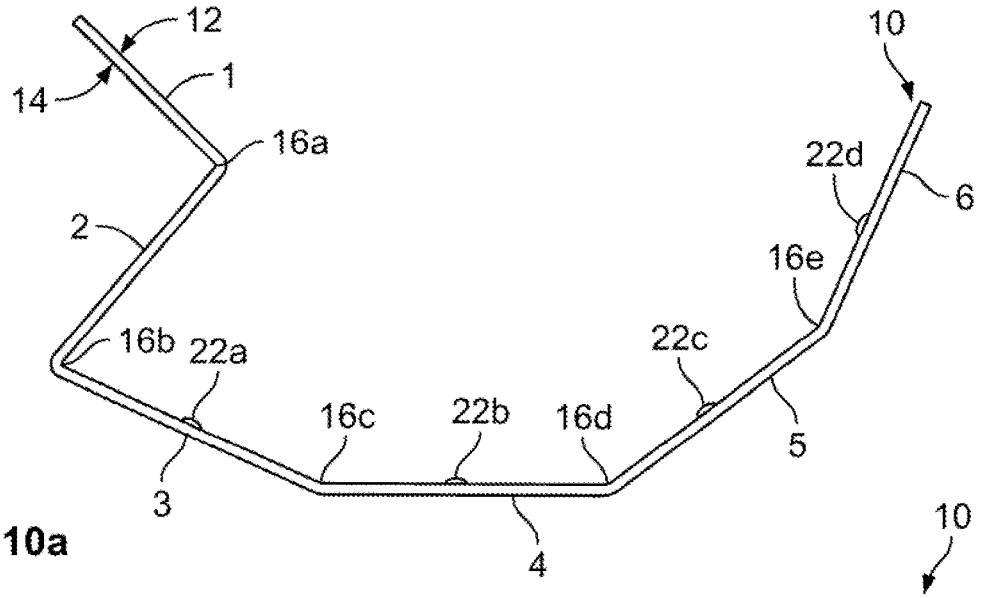
FIGS. 10A-10D show side views of the corrugated cardboard blank in various folding stages to illustrate the construction of an embodiment of the edge protector according to the present invention.
Figure 10B:
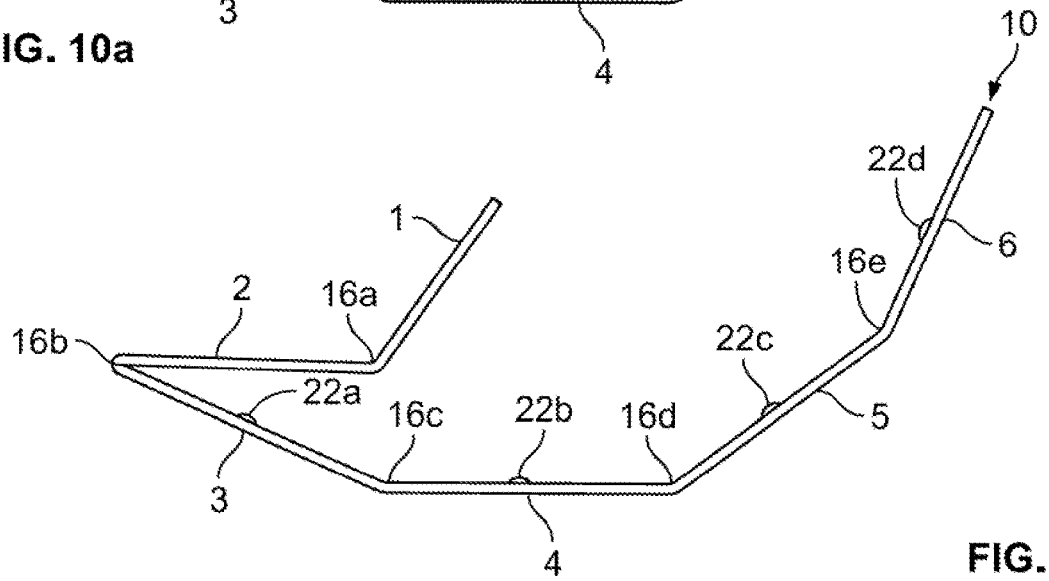
Figure 10C:
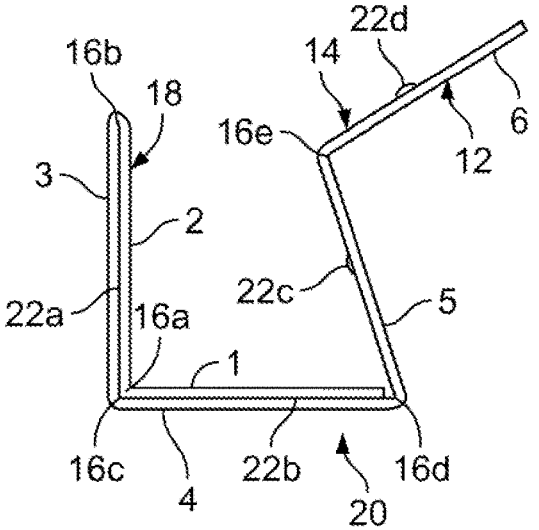
Figure 10D:
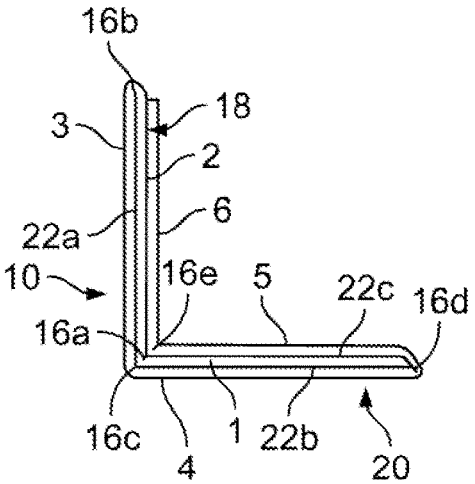

Referring to FIGS. 8 and 9, in a further advantageous embodiment of the invention, sheet 10 is scored to divide the sheet into six consecutive panels, instead of five, which produces a generally equal overall thickness between legs 18 and 20 by adding an additional panel to first leg 18. The folding arrangement is essentially the same as the five panel arrangement described above, except for the addition of a new fold line 16*e* that creates panel six, indicated by reference number 6, which overlaps panel 2 when folded. As shown in FIG. 9, fold lines 16*a-e* are scored into sheet 10 and laterally spaced to provide six panels of various widths as detailed above for the five panel embodiment. Preferably, panel 6 is formed having a width less than or equal to panel 2 so that panel 6 does not extend outwardly from the end of leg 18 when it is overlapped in face-to-face contact with panel 2.

It is advantageous to score fold lines 16*a* and 16*e* on bottom side 14 of sheet 10, while the rest of fold lines 16*b-d* are scored on top side 12 of sheet 10. As noted above, it is necessary for panel 1 to fold in an opposite manner from panels two, three, four and five, thereby necessitating fold line 16*a* to be scored on the bottom side of the sheet. Panel 6 also folds in an opposite direction from all the panels except panel 1, thus requiring a score line on the bottom 14 of sheet 10 to promote folding. While placing score lines 16*a* and 16*e* on bottom side 10 is preferable, it is not essential and the folding arrangement described herein can be accomplished regardless.

Glue lines 22*a-d* are placed on top side 12 of panels 3, 4, 5 and 6. As compared to the five panel embodiment, the addition of glue line 22*d* is preferred to secure panel 6 to bottom side 14 of panel 2 when folded. By placing glue line 22*d* on top side 12 of panel 6, all the glue can be place on a single side of sheet 10 during assembly so that additional glue does not have to be added during the folding process.

The preferred embodiment for the five panel embodiment described above sets forth that panels 3 and 4, which form the length of legs 18 and 20, are to be of equal length. However, for both the five and six panel embodiments, it is not necessary for panels 3 and 4 to be of equal lengths. This allows for unique applications in which one leg of the edge protector can be formed longer or shorter than the other leg (i.e. where it is preferred to have a 2" by 4" leg arrangement).

Referring to FIGS. 10*a*-10*d*, the folding arrangement for the six panel embodiment is illustrated. The arrangement is identical to that described above for the five panel embodiment, except for overlap of panel 2 by panel six, as detailed below. First leg 18 is formed from the overlapping of panels two, three, and six so that a top side of panel 2 is placed in face-to-face contact with a top side of panel 3, and a top side of panel 6 is placed in face-to-face contact with a bottom side of panel 2. Second leg 20 is formed from the overlapping of panels one, four, and five so that a top side of panel 1 is placed in face-to-face contact with a top side of panel 4, and a top side of panel 5 is placed in face-to-face contact with a bottom side of panel 1. An adhesive is included between the face-to-face contact of panels 2 and 3, panels 1 and 4, panels 1 and 5, and panels 2 and 6 for securing the panels in overlapping engagement to maintain the first and second legs in a fixed folded arrangement with each other. In a preferred embodiment, first leg 18 and second leg 20 intersect at approximately a 90° angle with each other.

In a further advantageous embodiment, panels 3 and 4 may be formed of an unequal width so that first leg 18 may be formed longer or shorter than second leg 20. Regardless of the length of panels 3 and 4, panel 2 will have a width less than that of panel 3, panel 1 will have a width less than that of panel 4, panel 5 will have a width greater than that of panel 1 and less than that of panel 4, and panel 6 has a width less than that of panels 2 and 3.

In an alternative embodiment, panels three and four may be constructed of equal width with panels 1, 2, 5 and 6 each have a width less than panels 3 and 4 individually.

Figure 11:
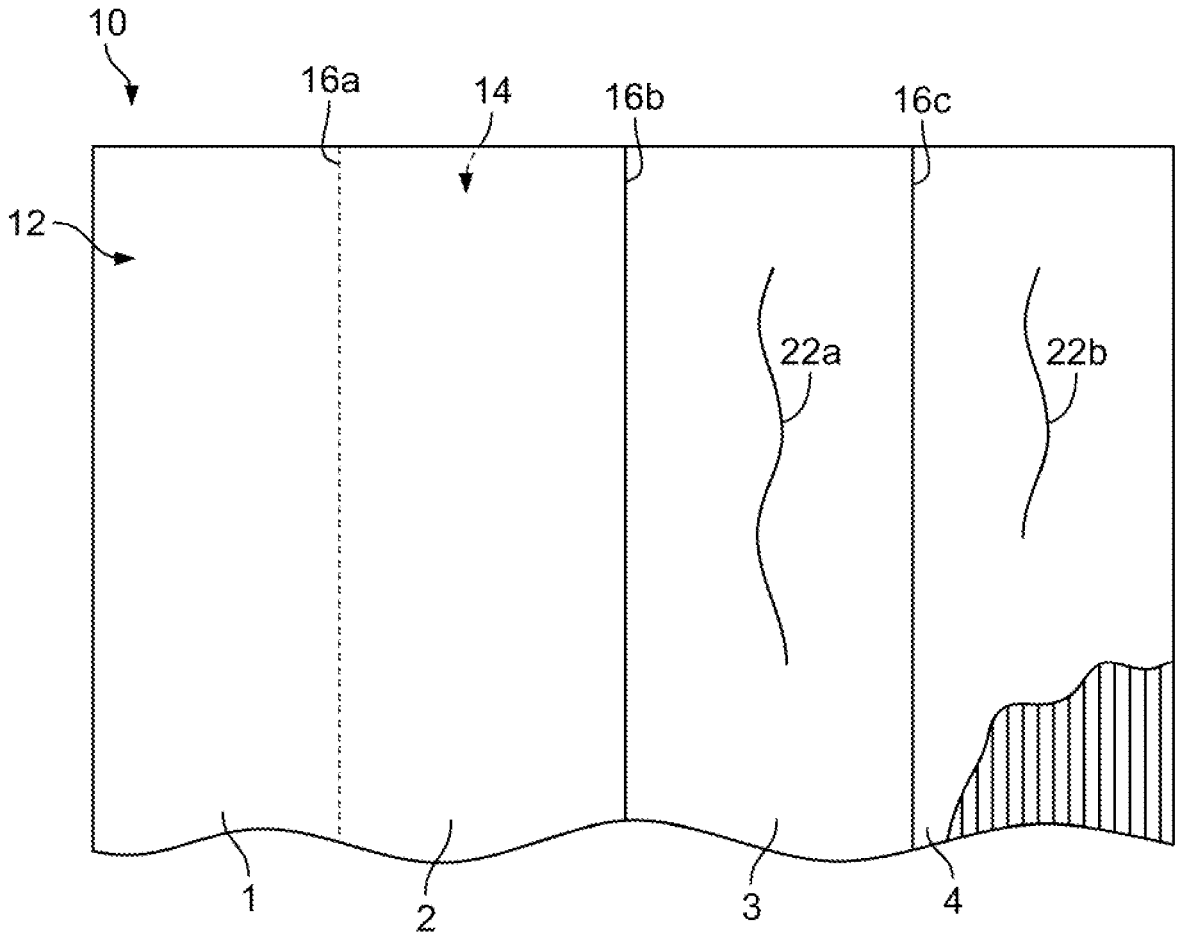
FIG. 11 shows a top view of a corrugated cardboard blank having scored fold lines according to an embodiment of the present invention.

In yet another embodiment, the sheet of foldable material 10, which has a top side 12 and a bottom side 14, may be provided with a plurality of parallel fold lines 16*a*-16*c* that divide the sheet into four consecutive panels numbered 1-4. In one embodiment, these fold lines 16*a*-16*c* are scored into the folding material. In alternate embodiments, however, these fold lines may be depressed or dented into the folding material by hand, gravity, machine or other means generally known in the art. The panels are accordingly hinged together at the fold lines to allow for easy folding of the panels into overlapping engagement. For the embodiment shown in FIGS. 11-12, it is advantageous for fold line 16*a* between panels 1 and 2 be placed on the bottom side 14 of sheet 10, while the rest of fold lines 16*b*-*c* are placed on top side 12 of sheet 10. As is described in detail below, it is preferred that panel 1 fold in an opposite manner as the rest of the panels, thereby necessitating fold line 16*a* to be placed on the bottom side of the sheet.

Figure 12A:
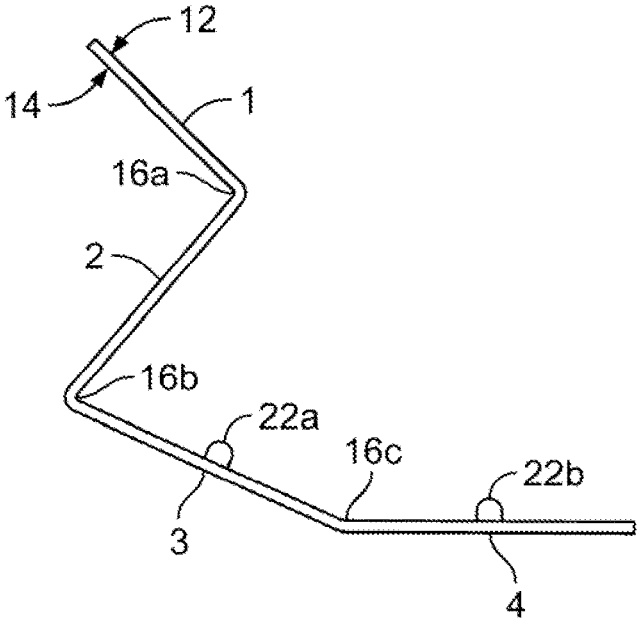
FIGS. 12A-12C show side views of the corrugated cardboard blank in various folding stages to illustrate the construction of an embodiment of the edge protector according to the present invention.
Figure 12B:
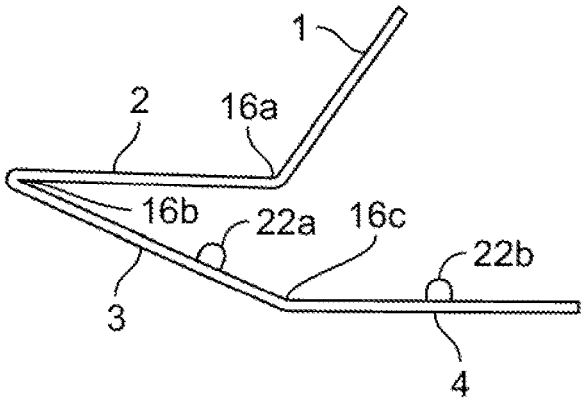
Figure 12C:
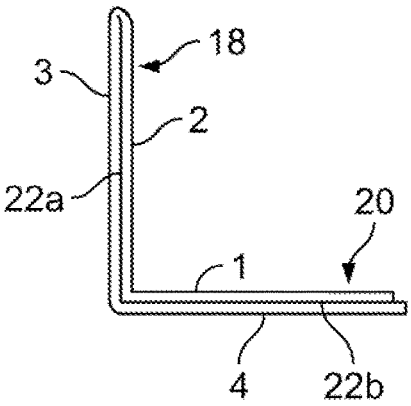

Prior to folding the sheet 10, it is advantageous to place adhesive 22*a* and 22*b* on the top side 12 of panels 3 and 4. That way, when the sheet 10 is folded, the sheet is held in place as folded. The methods for applying the adhesive are discussed above in relation to prior embodiments. As shown in FIGS. 12*a*-12*c*, after the fold lines 16*a*-16*d* have been created in the sheet 10, the sheet is folded at fold line 16*b* to place the top side 12 of panel 2 in a face-to-face contact with the top side 12 of panel 3 and the top side of panel 1 in face-to-face contact with the top side of panel four. As shown in FIG. 12C, the sheet may then be folded at fold lines 16*a* and 16*c* to place panels 1 and 4 in a generally perpendicular relation to panels 2 and 3. As shown in FIGS. 12A-12B, it is particularly advantageous, however, to first fold sheet 10 at fold line 16*a* between panels 1 and 2 to form approximately a 90° angle between panels 1 and 2 prior to folding panel 2 into overlapping engagement with panel 3, as shown in FIGS. 12*b*-*c*. Again, note that fold line 16*a* is preferably placed on bottom side 14 of sheet 10 to promote the folding of panel 1 as illustrated in the various Figures. Accordingly, when the sheet is folded at fold line 16*c* between panels 3 and 4 to form approximately a 90° angle between panels 3 and 4, panel 1 then comes into overlapping engagement with panel 4 and is already positioned at a 90° angle to panel 2, which provides good face-to-face contact between the panels.

Referring to FIG. 12C, first leg 18 and a second leg 20 are formed by placing panels 1 and 4, whose top sides are in face-to-face contact, in a generally perpendicular relation with respect to panels 2 and 3, whose top sides are in face to face contact. As is the case in previously discussed embodiments, an adhesive 22*a*-22*b* can be used to keep panels 2 and 3 in a face-to-face contact and to keep panels 1 and 4 in face to face contact.

Figure 13A:
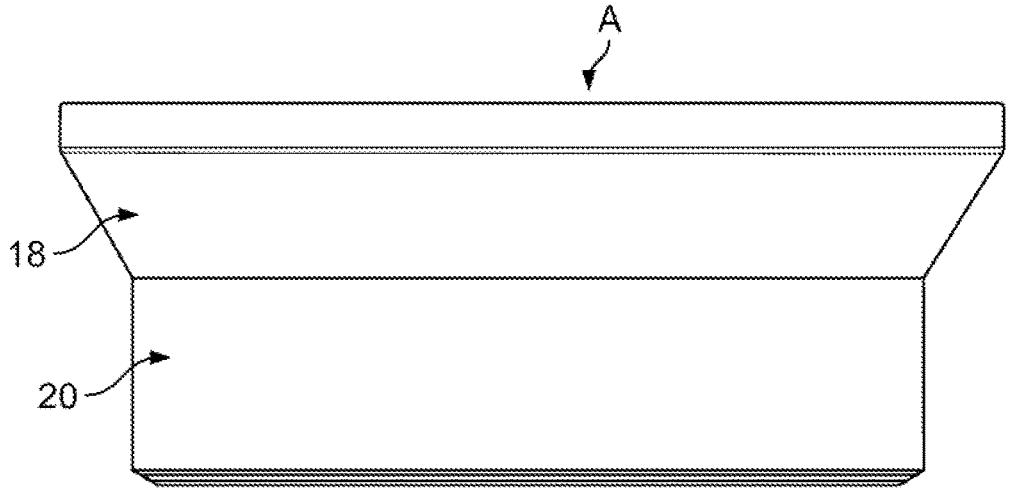
FIGS. 13*a*-13*c* show perspective views of an embodiment of the edge protector in various folding stages to illustrate the construction of a further embodiment of the edge protector according to the present invention; and, FIG. 14 shows a perspective view of an embodiment of the edge protector in use according to the present invention.
Figure 13B:
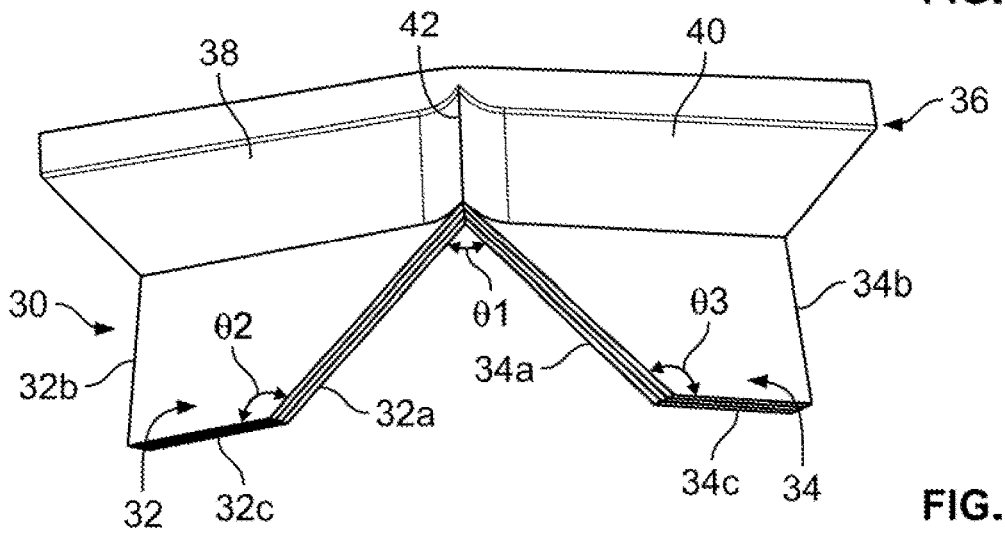
Figure 13C:
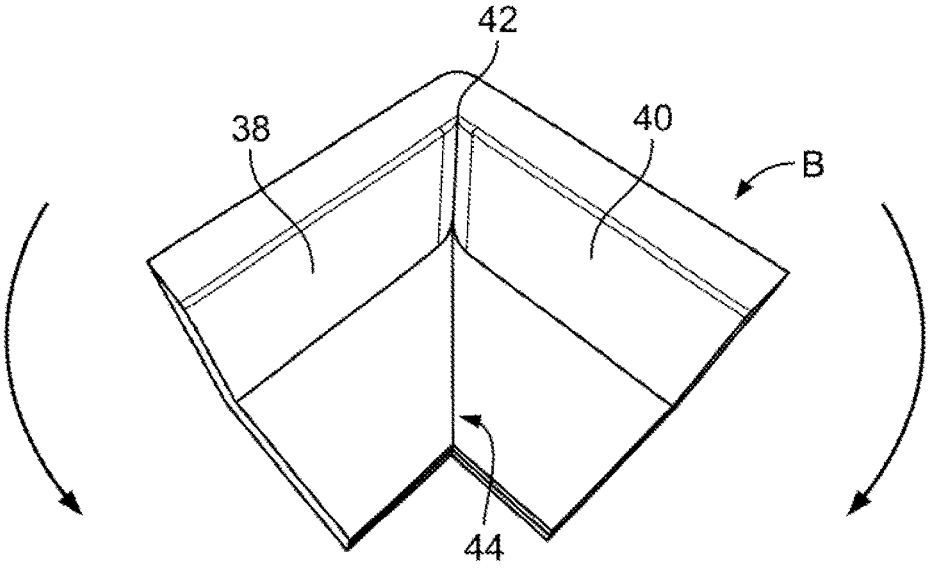

Referring now to FIGS. 13A-D, another embodiment of the present invention is shown. Regardless of how the edge protector A is created, whether by folding the panels as described above or by other novel or generally known methods, an edge protector adapted for protecting corners B can be formed as described below. As shown in FIG. 13A, an edge protector having a first leg (which can also be referred to as a first section) and a second leg (which can also be referred to as a second section) is provided. A notched section 30 is formed by removing material from either the first leg 18 or the second leg 20. In the shown embodiment, the notched section 30 is formed by removing a portion of the sheet 10 of foldable material and more specifically by removing a portion of the panels creating the second leg 20. In alternate embodiments, however, the notched section 30 can be formed by removing a portion of the sheet 10 of foldable material and more specifically by removing a portion of the panels creating the first leg 18. In either case, the material can be removed in any number of ways generally known in the art, including by use of cutting instruments such as scissors, knives, scalpels or the like. Alternatively, machines may be used to punch out the material using an anvil type cutting member. Regardless of the method used, a wedge shaped portion of material will be removed from one of the first and/or second legs 18 and 20, to create the notched section 30.

Once a portion of the sheet 10 has been removed, the notched section 30 will include a first leg 32 and a second leg 34. In the shown embodiment, both the first and second legs 32 and 34 include an inner longitudinal edge 32*a* and 34*a*, an outer longitudinal edge 32*b* and 34*b* and an outside edge 32*c* and 34*c*. In at least one embodiment, the first and second legs 32 and 34 of the notched section 30 will mirror one another. In alternate embodiments, however, these legs may not be mirror images of one another.

In one embodiment, the angle θ1 between the first leg's inner longitudinal edge 32*a* and the second leg's inner longitudinal edge 34*a* is 90 degrees. In alternate embodiments, the angle of θ1 can be greater or less than 90 degrees. Where θ1 is equal to 90 degrees, angle θ2 and θ3 will both be 135 degrees, where θ2 is the angle between the inner longitudinal edge 32*a* and the outside edge 32*c* of the first leg 32 and θ3 is the angle between the inner longitudinal edge 34*a* and the outside edge 34*c* of the second leg 34. By varying the degree of θ1, the degrees of θ2 and θ3 will be varied. In at least one embodiment the degrees of θ2 and θ3 are equal, but that is not always the case. However, angles θ2 and θ3 will be greater than 90 degrees.

In the shown embodiment, an un-notched section 36 comprises the first leg 18 of the edge protector depicted in FIG. 13A. The un-notched section 36 comprises the section where no material was removed to create the notched section 30. Thus, the un-notched section could be either the first leg 18 or the second leg 20 depending on which leg is used to form the notched section 30.

The un-notched section 36 includes a latitudinal fold line 42 that in at least one embodiment is located at the longitudinal midpoint of the un-notched section 36. In at least one embodiment, fold line 42 is depressed or dented into the un-notched section 36 by striking the un-notched section with sufficient force to create an indention but not to cut or otherwise break the surface of the un-notched section. In alternate embodiments, fold line 42 may be scored into un-notched section by means discussed above or generally known. A first side leg 38 and a second side leg 40 (which are also referred to at times simply as a third and fourth leg respectively) are formed by folding the un-notched section 36 at fold line 42. Preferably, first side leg 38 and second side leg 40 are placed in a generally perpendicular angular relation to one another but this is not always the case. In at least one embodiment, the outside edges 32*c* and 34*c* are shorter in length than the first side leg 38 and second side leg with which such outside edges correspond such that outside edge 32*c* has a length that is less than that of first side leg 38 and outside edge 34*c* has a length that is less than that of second side leg 40.

Preferably, the un-notched section 36 is folded at fold line 42 until the inner longitudinal edges 32*a* and 34*a* of the first and second legs 32 and 34 of the notched section 30 contact one another. The degree of the angle θ1 will determine the angular relation between the first side leg 38 and the second side leg 40, when the un-notched section is folded to place the inner longitudinal edges 32*a* and 34*a* in contact with one another. This way, the corner piece edge protector B can be used on items that have corners that are less or greater than 90 degrees.

Once the un-notched section 36 is folded to create the first side leg 38 and the second side leg 40, at least a portion of the first and second legs 32 and 34 of the notched section contact one another to form a top leg 44. In at least one embodiment, the top leg 44 is perpendicular to both the first and second side legs 38 and 40. The edge protector B can be held in this folded position where at least a portion of the two inner longitudinal legs 32*a* and 34*a* are in contact by means generally known in the art, including adhesive, staples and/or friction fit (where the box in which the article is placed maintains the folded position of edge protector B). In the embodiment shown in FIG. 14, a staple 48 is used to maintain this folded position.

Figure 14:
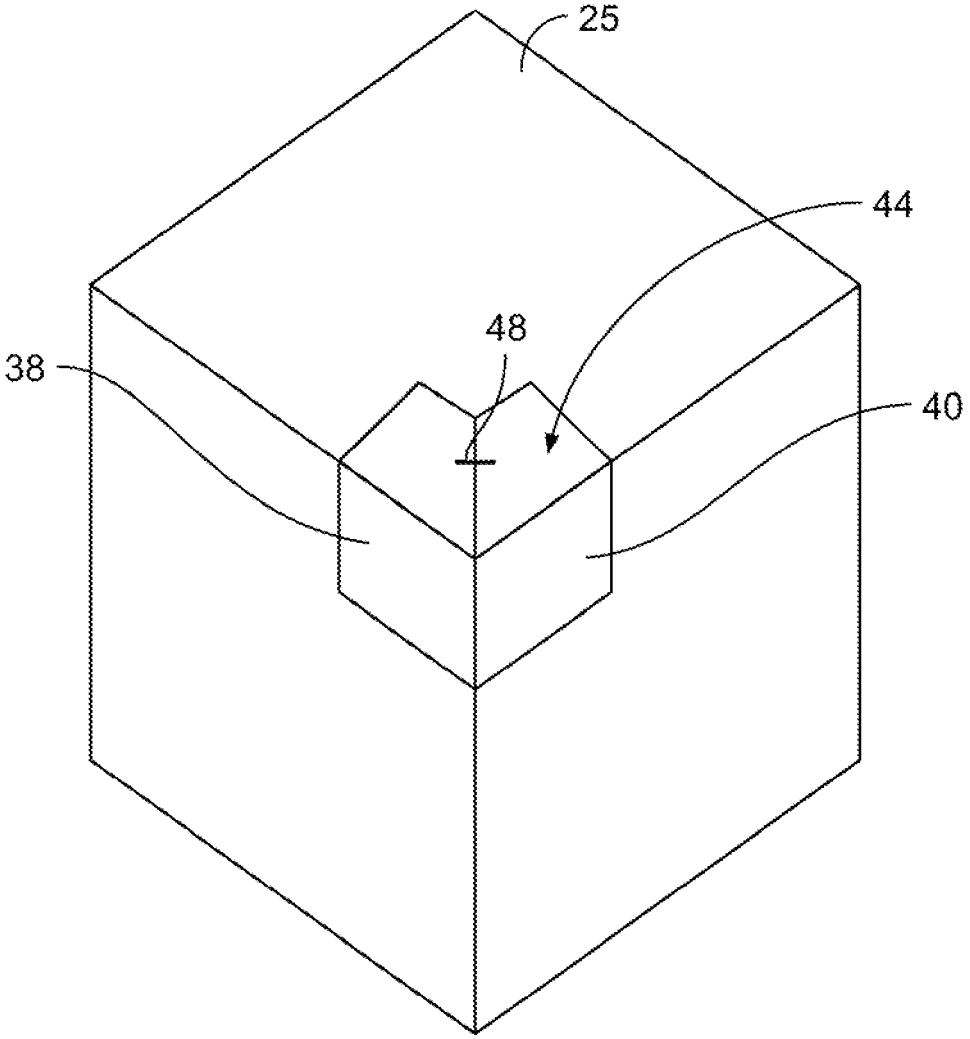

As shown in FIG. 14, when in use, the corner piece edge protector B can be placed on the corner of an item 25 so that the first side leg 38 and the second side leg 40 can protect the sides of the item while the top leg 44 can protect the top of the item. In alternate embodiments, however, the edge protector B can be placed on the item 25 such that one of the first and second side legs 38 and 40 protects a side of the item, while the other side leg protects the top of the item and the top leg 44 protects another side of the item. Essentially, the orientation in which the edge protector is placed on the item is not important so long as at least two sides and a top of the item are placed adjacent to the various legs 38, 40 and 44 of the edge protector B. Thus, reference to a side leg or a top leg should not be construed as requiring that a side leg be intended to or actually placed adjacent to a side surface of the item or a top leg be intended to or actually placed adjacent to a top surface of the item.

While a preferred embodiment of the invention has been described using specific terms, such description is for illustrative purposes only, and it is to be understood that changes and variations may be made without departing from the spirit or scope of the following claims.

What is claimed is:

1. An edge protector adapted for protecting edges and corners of an article or reinforcing the corners of a container when positioned therein, said edge protector comprising:

a sheet of foldable material having a top side and a bottom side;

a notched edge protecting section comprising at least two panels folded into an overlapping engagement;

an un-notched edge protecting section comprising at least two panels folded into an overlapping engagement wherein said un-notched edge protecting section extends outwardly from said notched edge protecting section; and a first leg and a second leg included in said notched edge protecting section each of said first leg and said second leg having an inner longitudinal edge, an outer longitudinal edge and an outside edge interconnecting said inner longitudinal edge and said outer longitudinal edge wherein said inner longitudinal edge of said first leg mirrors said inner longitudinal edge of said second leg and each of said inner longitudinal edges comprise a generally straight edge formed by said at least two panels and wherein an angle between said inner longitudinal edge and said outside edge is generally uniform and is greater than 90 degrees;

wherein said sheet of foldable material is divided into five consecutive panels and one of said notched edge protecting section and said un-notched edge protecting section is formed from the overlapping of panels one, four, and five so that a top side of panel one is placed in face-to-face contact with a top side of panel four, and a top side of panel five is placed in face-to-face contact with a bottom side of panel one; and a third leg and a fourth leg formed from the folding of said un-notched edge protecting section so that at least a portion of said inner longitudinal edge of said first leg contacts at least a portion of said inner longitudinal edge of said second leg.

2. The edge protector of claim 1 wherein said first and said second legs are perpendicular to said third and said fourth legs and the outside edge of said first leg is perpendicular to said outside edge of said second leg.

3. The edge protector of claim 1 wherein said first leg intersects with said third leg at an angle of approximately 90 degrees and said outside edge of said first leg has a length that is less than a longitudinal length of said third leg.

4. The edge protector of claim 1 wherein said blank sheet of foldable material comprises corrugated paperboard.

5. The edge protector of claim 1 wherein said sheet of foldable material further includes a sixth panel and one of said notched edge protecting section and said un-notched edge protecting section is formed from the overlapping of panels two, three, and six so that a top side of panel two is placed in face-to-face contact with a top side of panel three, and a top side of panel six is placed in face-to-face contact with a bottom side of panel two.

6. The edge protector of claim 1 wherein panels three and four are of unequal width so that said notched edge protecting section may be formed with a width that is different than the width of said un-notched edge protecting section, and wherein panel two has a width less than that of panel three.

7. The edge protector of claim 1 wherein said un-notched edge protecting section includes a fold line therein so that said un-notched edge protecting section can be folded to create said third leg and said fourth leg.

8. An edge protector adapted for protecting edges and corners of an article or reinforcing the corners of a container when positioned therein, said edge protector comprising:

a sheet of foldable material having a top side, a bottom side and a plurality of fold lines dividing said sheet into a panel one, a panel two, a panel three, a panel four and a panel five;

a notched edge protecting section defining a first leg and a second leg, and each of said first leg and said second leg having an inner longitudinal edge;

an un-notched edge protecting section that extends outwardly from said notched edge protecting section;

wherein one of said notched edge protecting section and said un-notched edge protecting section is formed from the overlapping of panels one, four and five so that a top side of panel one is placed into face to face contact with a top side of panel four and a top side of panel five is placed in face to face contact with a bottom side of panel one; and said un-notched edge protecting section defines a third leg and a fourth leg and overlapped panels of said inner longitudinal edge of said first leg generally abut overlapped panels of said inner longitudinal edge of said second leg in a non-overlapping manner.

9. The edge protector of claim 8 wherein said inner longitudinal edge of said first leg mirrors said inner longitudinal edge of said second leg.

10. The edge protector of claim 8 wherein one of said notched edge protecting section and said un-notched edge protecting section is formed from the overlapping of panels two and three so that a top side of panel two is placed in face to face contact with a top side of panel three.

11. The edge protector of claim 8 wherein said sheet of foldable material further includes a sixth panel and one of said notched edge protecting section and said un-notched edge protecting section is formed from the overlapping of panels two, three, and six so that a top side of panel two is placed in face-to-face contact with a top side of panel three, and a top side of panel six is placed in face-to-face contact with a bottom side of panel two.

12. An edge protector adapted for protecting edges and corners of an article or reinforcing the corners of a container when positioned therein, said edge protector comprising:

a sheet of foldable material having a top side and a bottom side;

a plurality of consecutive panels included in said sheet of foldable material that are hinged together to allow for easy folding of said panels into an overlapping engagement;

a first side leg and a second side leg, wherein said second side leg is integrally connected to said first side leg and is perpendicular to said first side leg;

a first top leg and a second top leg, wherein each of said first top leg and said second top leg include an outside edge that is adjacent to an inner longitudinal edge, said inner longitudinal edge comprising a plurality of panels folded into an overlapping engagement and wherein the angle between said outside edge and said plurality of panels of said inner longitudinal edge is uniform; and, wherein said sheet of foldable material is divided into a panel one, a panel two, a panel three, a panel four, and a panel five and one of said top leg and said first side leg and said second side leg is formed from the overlapping of panels one, four, and five so that a top side of panel one is placed in face-to-face contact with a top side of panel four, and a top side of panel five is placed in face-to-face contact with a bottom side of panel one.

13. The edge protector of claim 12 wherein said inner longitudinal edge of said first top leg mirrors said inner longitudinal edge of said second top leg.

14. The edge protector of claim 12 wherein said sheet of foldable material further includes a sixth panel and one of said top leg and said first side leg and said second side leg is formed from the overlapping of panels two, three, and six so that a top side of panel two is placed in face-to-face contact with a top side of panel three, and a top side of panel six is placed in face-to-face contact with a bottom side of panel two.

15. The edge protector of claim 12 wherein said plurality of panels of said inner longitudinal edge of said first top leg engage said plurality of panels of said inner longitudinal edge of said second top leg in a non-overlapping manner.

* * * * *